United States Patent [19]

Trinkel et al.

[11] Patent Number: 4,494,721

[45] Date of Patent: Jan. 22, 1985

[54] SEAT ADJUSTMENT MECHANISM FOR A CHAIR

[75] Inventors: Steven F. Trinkel, Rockport; Patrick E. Strange; Mathew A. Slaats, both of Jasper, all of Ind.

[73] Assignee: Kimball International, Inc., Jasper, Ind.

[21] Appl. No.: 463,528

[22] Filed: Feb. 3, 1983

[51] Int. Cl.[3] ..... F16M 11/00

[52] U.S. Cl. ..... 248/406.2; 411/274

[58] Field of Search ..... 248/406 A, 410, 297.5; 411/272, 276, 277, 259, 274, 275; 188/109, 71.1, 72.1

[56] References Cited

U.S. PATENT DOCUMENTS

| | | | |
|---|---|---|---|
| 1,777,204 | 9/1930 | Korsten et al. . | |
| 2,702,075 | 6/1953 | Richards . | |
| 3,164,357 | 1/1965 | Hage et al. . | |
| 3,227,113 | 1/1966 | Kupski . | |
| 3,534,937 | 10/1970 | Heinzel . | |
| 3,727,871 | 4/1973 | Harper . | |
| 3,870,271 | 3/1975 | Bowman . | |
| 3,877,502 | 4/1975 | Hunckler | 411/274 |
| 3,991,965 | 11/1976 | Westover et al. . | |
| 4,026,509 | 5/1977 | Wolters . | |
| 4,220,187 | 9/1980 | Holmes | 411/274 |

FOREIGN PATENT DOCUMENTS

| | | | |
|---|---|---|---|
| 687506 | 1/1940 | Fed. Rep. of Germany . | |
| 177039 | 3/1922 | United Kingdom | 411/259 |
| 354602 | 8/1931 | United Kingdom | 411/259 |
| 647183 | 12/1950 | United Kingdom . | |
| 870781 | 10/1981 | U.S.S.R. | 411/259 |

*Primary Examiner*—William H. Schultz
*Assistant Examiner*—Robert A. Olson
*Attorney, Agent, or Firm*—Jeffers, Irish & Hoffman

[57] ABSTRACT

A seat adjustment mechanism for adjustably connecting a seat to a chair base is provided wherein a threaded spindle is secured to the seat and rotatably and axially movably received within a column member extending upwardly from the chair base. An adjusting nut is threadedly engaged with the spindle and supported within the column member by a bearing assembly, and which is upwardly urged by a compression spring such that the upper surface of the adjusting nut lockingly engages a downwardly facing engaging surface of a lock cap in the column member when the seat is unoccupied. By rotating the seat and the spindle secured thereto, vertical adjustment of the seat is provided. When the seat is occupied, the adjusting nut is moved downwardly by the spindle and against the bearing assembly to compress the spring and disengage the upper surface of the adjusting nut from the downwardly facing engaging surface. The seat and spindle then may be rotated without being vertically adjusted.

19 Claims, 5 Drawing Figures

SEAT ADJUSTMENT MECHANISM FOR A CHAIR

BACKGROUND OF THE INVENTION

This invention pertains to a swivel chair, and more particularly to a swivel chair having a seat adjustment mechanism for adjusting the height of the chair seat.

Generally, prior art swivel chairs comprise a seat connected to a base member by an adjusting assembly, which permits the seat to be vertically moved relative to the base member. The adjusting assembly generally comprises a threaded spindle secured to the seat and supported by the base member, and a nut threaded to the spindle. In the unoccupied state, a resilient device urges the nut into locking engagement with a column member extending upwardly from the base member and into which the threaded spindle is received. In this manner, the seat and spindle may be rotated relative to the locked adjusting nut and base member to thereby vertically adjust the seat.

When the seat is occupied, the resilient device is compressed to disengage the nut from the column member so that, upon rotation of the seat and spindle, the nut rotates with the spindle to prevent any vertical adjustment of the seat.

Important to the proper operation of an adjustable swivel chair is the capability of the adjusting assembly to lockingly engage and disengage the nut with the column member in a simple, reliable, and efficient manner. In most prior art swivel chairs, the locking of the nut against rotation with the spindle is accomplished by the resilient device urging the nut, which has a groove or notch disposed therein, into locking engagement with a stop or catch radially inwardly disposed from the column member. A disadvantage in some prior art swivel chairs having this type of adjusting assembly is that the chair is rotated a full or half turn in order to properly engage the nut with the column member.

Furthermore, in those instances wherein the column member has a stop or catch radially inwardly disposed, the possibility exists for the stop or catch to be broken off or bent preventing proper engagement between the nut and the column member, thereby precluding vertical adjustment of the seat.

When these prior art swivel chairs are occupied, the resilient device is compressed to disengage the nut from the column member to allow the nut to rotate with the spindle, thereby preventing vertical adjustment of the seat upon rotation. To insure the nut rotates with the spindle, a washer having a plurality of axially extending projections thereon and keyed to the spindle, or a similar device, may be disposed between the resilient device and the nut, which has a like plurality of complementary projection-receiving grooves disposed therein. When the seat is occupied or weighted and rotated, the resilient device, washer, and nut are compressed together so that the projections are lockingly received within the grooves, thereby insuring the nut rotates with the spindle. However, when this swivel chair is unoccupied and the seat rotated for vertical adjustment, the nut and the washer slidably rotate relative to each other causing an undesirable bumping or jarring effect because of the projections rotatably engaging and disengaging the grooves in the nut.

Another disadvantage, is the eventual wearing down of the projections or grooves to such an extent that, upon the seat being occupied or weighted, the nut may not properly lock for rotation with the spindle.

In other types of prior art swivel chairs, the resilient device may be found to be disposed between the nut and the portion of the column member with which the nut is lockingly engageable. Various means or devices are provided for locking the nut to the column member, however, the undesirable possibility exists that the means or device may become hung up or engaged by the resilient device, thereby preventing vertical adjustment of the chair.

A problem which can be encountered in chair height adjustment mechanisms of the general type discussed above is the tendency of the adjustment nut to rotate relative to the spindle when the chair is occupied and when no adjustment in the chair height is desired. When using a Teflon bearing, for example, a "slip-stick" phenomenon occurs wherein the coefficient of friction between the metal adjusting nut or metal bearing washer and the Teflon bearing is larger under static conditions than it is when the two elements are moving relative to each other as the chair is rotated. If the static frictional forces are sufficiently great, they may be higher than the forces between the adjusting nut and spindle so that the nut rotates relative to the spindle when the chair is occupied and results in an undesirable change in the height of the chair. Increasing the friction between the nut and spindle at all times, however, is not desirable because of the desirability of the nut rotating freely relative to the spindle while the chair height is being adjusted.

SUMMARY OF THE INVENTION

The present invention overcomes the disadvantages of the above prior art swivel chairs by providing an improved seat adjustment mechanism therefor.

One feature of the seat adjustment mechanism of the present invention is the provision of a downwardly facing engaging surface on the column member and an upper surface on the adjusting nut engageable therewith. When the seat is unoccupied, a resilient device acting below the adjusting nut urges the nut upwardly into locking engagement with the downwardly facing engaging surface of the column member. Upon rotation of the spindle relative to the locked adjusting nut, the seat may be vertically adjusted as desired. The provision of a downwardly facing engaging surface in place of a stop or catch as in some prior art swivel chairs eliminates the disadvantage of the stop or catch possibly breaking off or becoming bent after prolonged use.

Necessary for the proper functioning of an adjustable swivel chair is that the nut rotate with the spindle when the chair is occupied or weighted and then rotated. As earlier described, some prior art swivel chairs utilize a keyed washer have a plurality of projections thereon between the resilient device and the nut for engaging complementary grooves or notches in the nut when the seat is occupied or weighted. The seat adjustment mechanism of the present invention dispenses with the need of such a washer and its accompanying disadvantage as mentioned earlier by providing a unique bearing assembly between the resilient device and the nut. The bearing assembly comprises a plurality of washers wherein at least one of the washers is made of a polytetrafluoroethylene material, under the trademark TEFLON.

In order to increase the frictional forces between the adjusting nut and spindle when the chair is occupied, the lower surface of the adjusting nut is provided with a slight taper so that when it bottoms against the washer assembly when the chair is occupied, it tilts slightly relative to the spindle and binds against the threads of the spindle. This increases the frictional forces so that the nut will rotate with the spindle when the chair is occupied and relative to the Teflon bearing. When the chair is unoccupied, however, the binding forces on the nut are released so that the spindle can turn freely relative to the nut thereby affording easy adjustment.

The unique feature of the bearing assembly is that it provides a lower coefficient of friction or frictional force between the nut and itself than the friction forces between the nut and spindle, so that upon rotation of the occupied or weighted seat the nut easily rotates with the spindle. This eliminates the bumping or jarring effect associated with the earlier described prior art swivel chairs.

A further desirable feature of the seat adjustment mechanism of the present invention is the direct positive engagement between the nut upper surface and the downwardly facing engaging surface of the column member. Since the resilient device is below the adjusting nut, and not between the nut and the portion of the column member engaged by the nut, there is no need for a means or device for engaging the nut with the column member.

In one form of the invention there is provided an improved seat adjustment mechanism comprising a column member extending upwardly from a support member and having disposed in a hollow portion thereof a lock cap having a downwardly facing engaging surface, and a vertically disposed spindle secured to a seat and having a threaded surface thereon and which is rotatable and axially movably received in the hollow portion of the column member and encircled by the lock cap. Threadedly engaged with the spindle threaded surface is an adjusting nut, which is axially below the downwardly facing engaging surface. The adjusting nut has an upper surface engageable with the downwardly facing engaging surface, and a resilient device between the lower surface of the adjusting nut and the column member supports the spindle therein. The resilient device upwardly urges the adjusting nut into locking engagement with the downwardly facing engaging surface, whereby the nut is locked against rotation with the spindle so that the seat may be vertically adjusted by rotation of the spindle relative to the locked adjusting nut. When the seat is occupied or a weight added thereto, the resilient device enables the adjusting nut to be downwardly moved to disengage from the downwardly facing engaging surface so that the adjusting nut rotates with the spindle during rotation of the weighted or occupied seat, thereby preventing vertical adjustment thereof. There is also included means operative when the seat is weighted for causing a degree of binding between the nut and spindle threads to thereby increase the frictional forces therebetween.

It is an object of the present invention to provide an improved seat adjustment mechanism for a chair wherein the chair seat rotates smoothly both when occupied and when being adjusted.

Another object of th present invention is to provide a seat adjustment mechanism for a chair wherein the spindle is prevented from rotating relative to the nut when the chair is occupied so that undesired changes in chair height will be avoided.

A further object of the present invention is to provide a seat adjustment mechanism for a chair that is simple, reliable, and efficient in operation.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
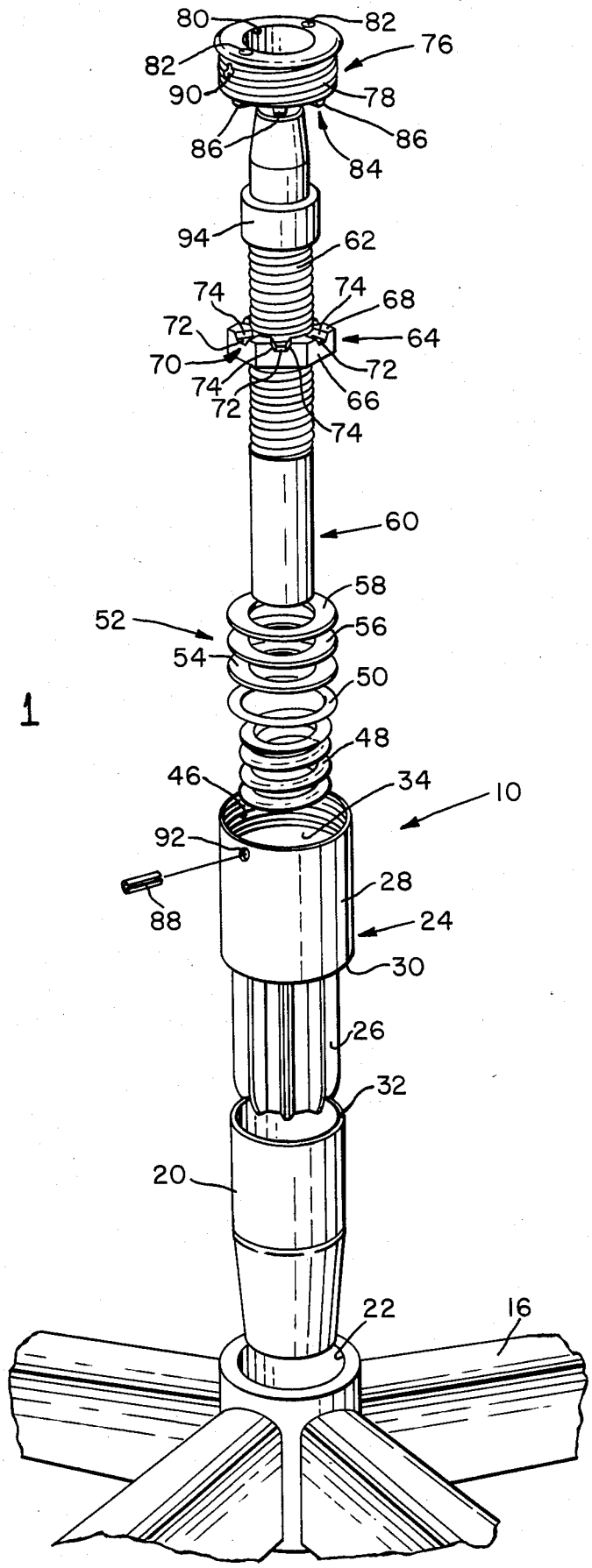
FIG. 1 is an exploded view of a preferred embodiment of the present invention.
Figure 4:
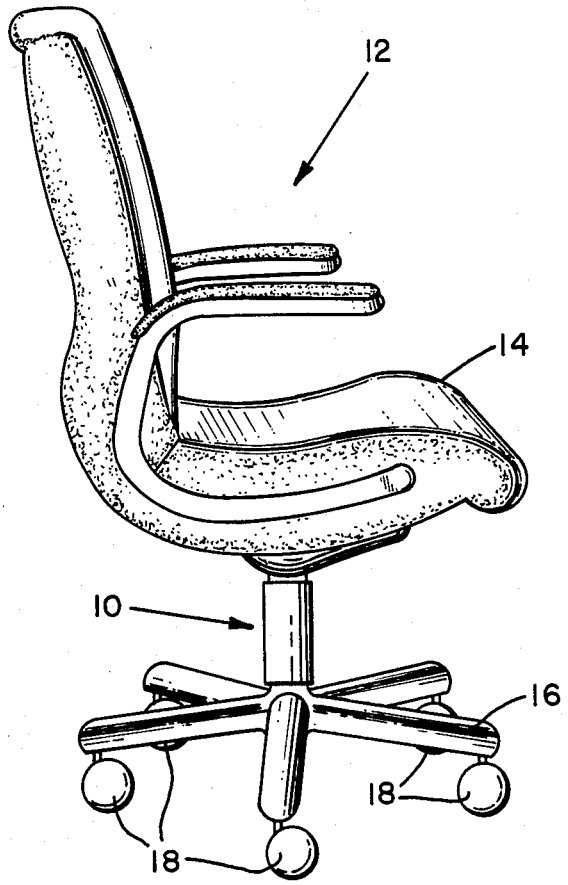
FIG. 4 is a perspective view of a chair incorporating a preferred embodiment of the present invention.

Referring to FIGS. 1 and 4, seat adjustment mechanism 10 is illustrated in an exploded view and incorporated in chair 12 having seat 14 and chair base 16, which may or may not be provided with casters 18.

Figure 2:
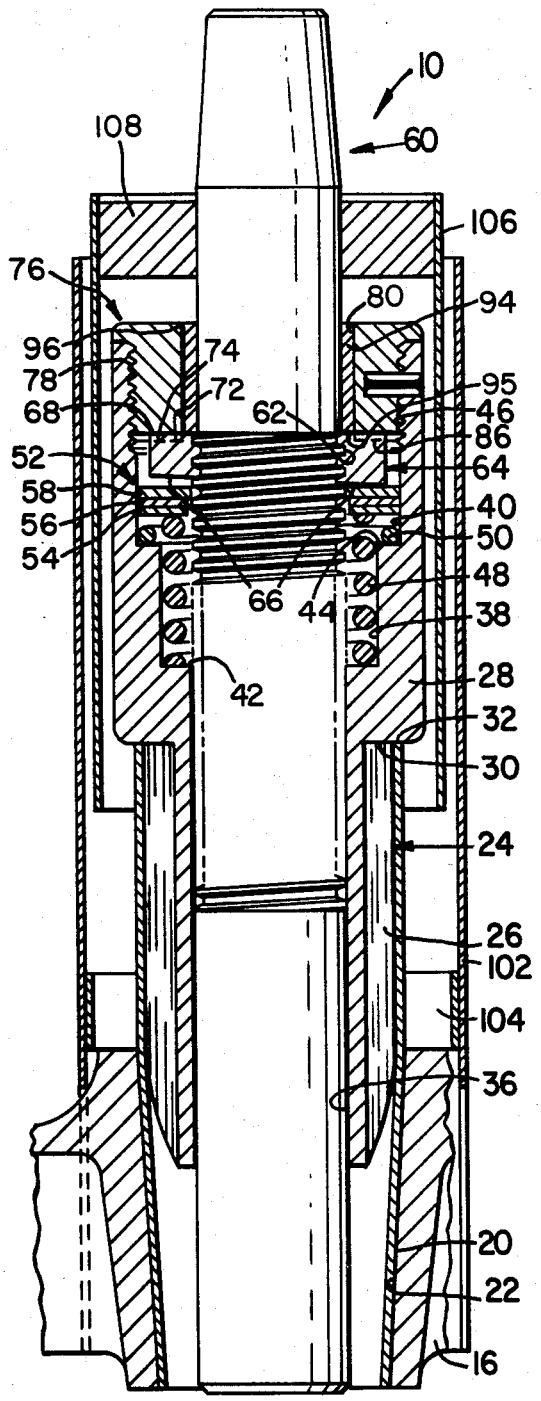
FIG. 2 is a broken-away, sectional view of a preferred embodiment of the present invention with the seat unoccupied.
Figure 3:
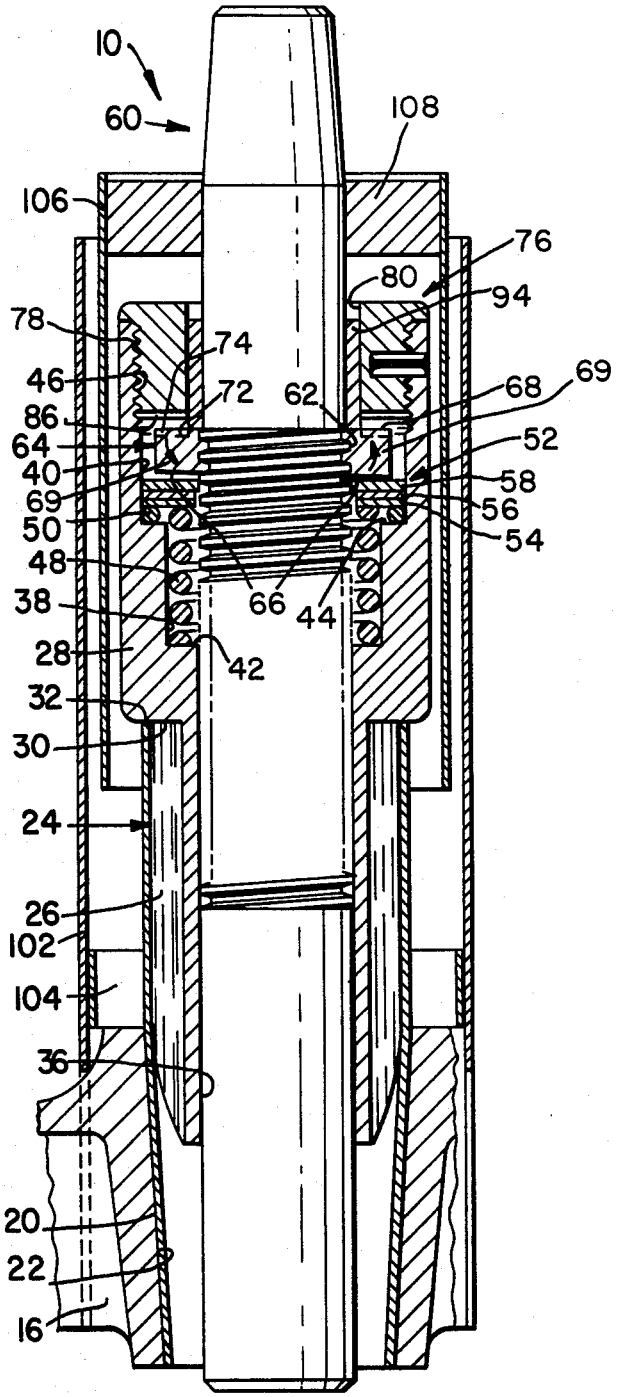
FIG. 3 is a broken-away, sectional view of a preferred embodiment of the present invention with the seat occupied.

Referring now to FIGS. 1–3, column 20 is received within opening 22 of chair base 16 and secured therein in any suitable manner. Column 20 is hollow for receiving column bushing 24 which has a lower ribbed section 26 joined to an upper cylindrical section 28 at shoulder 30. Column bushing 24 is preferably integrally made of acetal, and is secured within column 20 against rotation by press-fitting or by other suitable means. When secured within column 20, shoulder 30 axially abuts against top periphery 32 of column 20.

Column bushing 24 is generally cylindrically-shaped with a hollow portion 34 axially disposed therein. Hollow portion 34 is formed by bore 36 and two counterbores 38 and 40, which form annular shoulders 42,44, respectively, in hollow portion 34. Counterbore 40 is also provided with a circumferentially disposed threaded surface 46.

Continuing to refer to FIGS. 1–3, compression spring 48 is received within hollow portion 34 and supported by shoulder 42, and has an outer diameter just slightly smaller than the inner diameter of counterbore 38 so that compression spring 48 may easily compress and expand. O-ring 50 is received within hollow portion 34 and is supported by shoulder 44. O-ring 50 abuts against counterbore 40, and is preferably made of a silicone or like material.

A bearing assembly 52 is positioned within hollow portion 34 above O-ring 50 and comprises a flat bearing washer 54 on O-ring 50, bearing 56, and flat bearing washer 58; bearing 56 being preferably made of TEFLON, a polytetrafluoroethylene material. Bearing assembly 52 may have more washers if desired, and if so it is preferred that a TEFLON or similar bearing 56 be positioned between the adjacent additional washers. The outer diameters of washers 54, 58 and 56 are just slightly smaller than the inner diameter of counterbore 40 so that washers 54, 58 and bearing 56 may easily move axially within counterbore 40 with minimal radial movement.

A spindle 60 having a threaded surface 62 with height adjusting nut 64 threadedly engaged thereto is rotatably and axially movably received within hollow portion 34. The maximum diameter of spindle 60 is just slightly smaller than the inner diameter of bore 36 so that spindle 60 may easily rotate and axially move within bore 36. Lower surface 66 of steel adjusting nut 64 rests upon washer 58, and adjusting nut 64 is radially spaced-apart from the inner surface of counterbore 40.

The upper surface 68 of height adjusting nut 64 is provided with a plurality of grooves 70, each groove 70 having a horizontally flat surface 72 with opposite surfaces 74 extending upwardly and outwardly therefrom in a wedge-like fashion.

Height adjusting cap 76 having a threaded outer surface 78 and opening 80 disposed therein is slidably received over spindle 60 with threaded surface 78 threadedly engaging threaded surface 46 of column bushing 24. The diameter of opening 80 is greater than the maximum diameter of spindle 60 so that spindle 60 is in radial spaced-apart relation with height adjusting cap 76, and two holes 82 are provided in the top surface of height adjusting cap 76 to allow cap 76 to be securely engage to column bushing 24. Height adjusting cap 76 has a downwardly facing engaging surface 84 with a plurality of teeth 86 extending axially downwardly therefrom. Teeth 86 are shaped complementary to grooves 70 of adjusting nut 64 such that grooves 70 are lockingly engageable with teeth 86. To further secure cap 76 to bushing 24, two diametrically disposed spring pins 88 are inserted in cap 76 and bushing 24 although only a single spring pin 88 is illustrated as received within hole 90 radially disposed in height adjusting cap 76 and hole 92 radially disposed in column bushing 24. Height adjusting cap 76 is preferably made of a nylon or plastic material.

A stop collar 94 is connected to spindle 60, as by spot welding, for example, and the lower surface 95 thereof defines the lower limit to which spindle 60 can be adjusted. The upper limit for the adjustment of spindle 60 is determined by the ends of the threaded surface 62.

A cylindrically-shaped shroud 102 is connected to chair base 16 and extends upwardly therefrom encompassing seat adjustment mechanism 10, and is spaced thereapart by shroud spacer 104. Cylindrically-shaped upper bell 106 encompasses a portion of spindle 60 and rubber washer 108, and is slidably received within shroud 102 in a telescopic manner so that seat adjustment mechanism 10 is protected throughout its operation.

Figure 5:
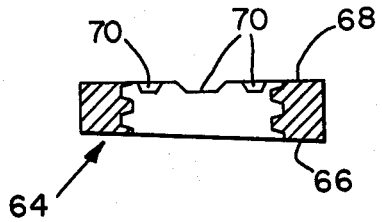
FIG. 5 is a sectional view of the height adjustment nut shown in FIGS. 1–3.

As illustrated in FIG. 5, adjusting nut 64 has its lower surface 66 tapered in the lateral direction with a 2°30′ taper. As will be described below, the taper causes a binding to occur between the threads of nut 64 and the threads of spindle 60 when the chair is occupied so that nut 64 will rotate with spindle 60.

Referring now to FIGS. 2 and 3, the operation of seat adjustment mechanism 10 will be described. When seat 14 is unoccupied, compression spring 48 urges bearing assembly 52 and height adjustment nut 64 upwardly such that teeth 86 of height adjusting cap 76 are lockingly engaged by respective grooves 70 in upper surface 68 of height adjusting nut 64. Because height adjusting nut 64 is now secured against rotation relative to spindle 60 by height adjusting cap 76, rotation of seat 14 and spindle 60 will cause spindle 60 to be adjusted upwardly or downwardly depending on the direction of rotation of seat 14. Recall that the outer diameters of washers 54,56,58 are just slightly smaller than the inner diameter of counterbore 40 so that washers 54, 58 and bearing 56 may easily move axially with minimal radial movement in counterbore 40. Further, the inner diameters of washers 54,58 and bearing 56 are selected such that threaded surface 62 of spindle 60 is spaced thereapart during operation of seat adjustment mechanism 10. Further, should any of the washers 54,58 or bearing 56 rotate slightly or with spindle 60, there is no bumping or jarring as in the earlier described prior art swivel chairs.

When seat 14 is occupied or weighted, spindle 60 is moved downwardly to disengage adjusting nut 64 from height adjusting cap 76 (FIG. 3). When adjusting nut 64 bottoms out against washer assembly 58, 56, 54, the axial forces will exert a bending moment on nut 64 in the direction illustrated by arrows 69 so that nut 64 will tend to tilt. This will cause a binding between the threads of nut 64 and the threads of spindle 60 so that the frictional forces therebetween will increase and nut 64 will rotate relative to bearing washer 56. Compression spring 48 is compressed by bearing assembly 52, and, since the frictional force between adjusting nut 64 and spindle 60 is much greater than the frictional force between adjusting nut 64 and bearing assembly 52, adjusting nut 64 rotates with spindle 60 when seat 14 is rotated, thereby preventing vertical adjustment. When the chair is unoccupied, the binding forces are released, and spindle 60 can rotate freely with respect to nut 64.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A seat adjustment mechanism for adjustably connecting a seat to a support member comprising:

a column member extending upwardly from said support member and having disposed in a hollow portion thereof a lock cap having a downwardly facing engaging surface, a vertically disposed spindle secured to said seat and having a threaded surface thereon, said spindle being rotatably and axially movably received in said hollow portion of said column member, said lock cap encircling said spindle, an adjusting nut threadedly engaged with said spindle threaded surface, said adjusting nut being axially below said downwardly facing engaging surface and having an upper surface engageable with said downwardly facing engaging surface, and resilient means between a lower surface of said adjusting nut and said column member, said resilient means upwardly urging said adjusting nut to lockingly engage said adjusting nut upper surface with said downwardly facing engaging surface, whereby said adjusting nut is locked against rotation with said spindle and said seat may be vertically adjusted by the rotation of said spindle relative to said locked adjusting nut, said resilient means enabling said adjusting nut to be downwardly moved to disengage said adjusting nut upper surface from said downwardly facing engaging surface when weight is applied to said seat, whereby said adjusting nut rotates with said spindle during rotation of said weighted seat to prevent vertical adjustment thereof, and means made operative when the seat is weighted for causing said nut to tilt relative to said spindle thereby causing a degree of binding between the nut threads and the spindle threads to thereby increase the frictional forces therebetween.

2. The mechanism of claim 1 wherein said column member includes an outer cylindrically-shaped wall and an inner bushing member secured thereto, said inner bushing member supporting said resilient means thereon.

3. The mechanism of claim 2 wherein said resilient means is a compressed spring.

4. The mechanism of claim 2 wherein said inner bushing member is made of a plastic material.

5. The mechanism of claim 1 further comprising bearing means between said resilient means and said lower surface of said adjusting nut.

6. The mechanism of claim 5 wherein said means for causing binding comprises a taper on the lower surface of said adjusting nut whereby a tilting moment is applied to said nut by said bearing means as said nut is forced against said bearing means to thereby cause a degree of binding between the nut and spindle threads.

7. The mechanism of claim 6 wherein said bearing means is a plurality of flat washers, at least one of said flat washers being made of a polytetrafluoroethylene material.

8. The mechanism of claim 1 wherein said resilient means is a compressed spring.

9. The mechanism of claim 1 further comprising a first shroud member extending upwardly from said support member and encompassing said column member in spaced-apart relationship therewith, and a second shroud member connected to said spindle and extending axially therealong in spaced-apart relationship, said second shroud member being rotatably and axially movably receivable in said first shroud member.

10. The mechanism of claim 9 further comprising a spacer member between said first shroud member and said column member to maintain their spaced-apart relationship.

11. The mechanism of claim 1 further comprising bearing means between said resilient means and the lower surface of said adjusting nut to enable said nut to rotate relative to said column member when weight is applied to the seat, and wherein said means for causing binding comprises means on the lower surface of said adjusting nut for causing said nut to tilt relative to said spindle thereby causing binding between the nut and spindle threads.

12. An adjustable swivel chair, comprising:

a support member having a column means extending upwardly therefrom, said column means having therein a hollow portion and a downwardly facing engaging surface, a seat having a vertically disposed spindle secured thereto, said spindle having a threaded surface thereon and being rotatably and axially movably received in said hollow portion, an adjusting nut threadedly engaging a portion of said spindle threaded surface that is axially below said downwardly facing engaging surface, said adjusting nut having an upper surface lockable with said downwardly facing engaging surface, and resilient means axially between a lower surface of said adjusting nut and said column means for supporting said spindle in said column means, said resilient means upwardly urging said adjusting nut to lockingly engage said adjusting nut upper surface with said downwardly facing engaging surface, whereby said adjusting nut is locked against rotation with said spindle, and said seat may be vertically adjusted by the rotation of said spindle relative to said locked adjusting nut, said resilient means enabling said adjusting nut to be downwardly moved to disengage said adjusting nut upper surface from said downwardly facing engaging surface when weight is applied to said seat, whereby said adjusting nut rotates with said spindle during rotation of said weighted seat to prevent vertical adjustment thereof, and means made operative when the seat is weighted for causing said nut to tilt relative to the spindle thereby causing a degree of binding between the nut thread and spindle threads to thereby increase the frictional forces therebetween.

13. The chair of claim 12 wherein said adjusting nut is radially spaced-apart from said column means.

14. The chair of claim 12 wherein said column means includes a cylindrically-shaped bushing member disposed between said spindle and said column means, said bushing member supporting said resilient means thereon.

15. The chair of claim 14 wherein said bushing member is secured against rotation to said column means, and said downwardly facing engaging surface is disposed from said bushing member.

16. The chair of claim 15 wherein said bushing member is made of a plastic material.

17. The chair of claim 12 wherein said resilient means is a compressed spring.

18. The chair of claim 12 further comprising bearing means between said resilient means and said lower surface of said adjusting nut, said bearing means including a plurality of washers, at least one of said washers being made of a polytetrafluoroethylene material.

19. The chair of claim 12 further comprising a first shroud member extending upwardly from said support member and encompassing said column means in spaced-apart relationship therewith, and a second shroud member connected to said spindle and extending axially therealong in spaced-apart relationship, said second shroud member being rotatably and axially movably receivable in said first shroud member.

* * * * *